United States Patent [19]

Marchadour

[11] 4,437,290

[45] Mar. 20, 1984

[54] MACHINE FOR CRIMPING IN A CONTROLLED ATMOSPHERE

[76] Inventor: Jean-Charles Marchadour, La Feuilleraie, Kerbascol, St Jean Trolimon, France, 29120 Pont l'Abbe

[21] Appl. No.: 312,304

[22] Filed: Oct. 16, 1981

[30] Foreign Application Priority Data

Oct. 17, 1980 [FR] France ..... 80 22241

[51] Int. Cl.[3] ..... B65B 31/02

[52] U.S. Cl. ..... 53/97; 53/331; 53/510

[58] Field of Search ..... 53/86, 97, 331, 334, 53/510; 83/564; 312/275, 315, 326; 493/158, 159, 477; 413/31

[56] References Cited

U.S. PATENT DOCUMENTS

| | | | |
|---|---|---|---|
| 2,047,423 | 7/1936 | Mallory | 53/97 X |
| 2,183,903 | 12/1939 | Ardron | 53/97 |
| 2,268,301 | 12/1941 | Pratt | 53/97 |
| 2,875,566 | 3/1959 | Sevenpifer | 53/334 |
| 4,008,658 | 2/1977 | Stock | 53/510 X |

FOREIGN PATENT DOCUMENTS

| | | | |
|---|---|---|---|
| 363641 | 12/1931 | United Kingdom | 413/31 |

*Primary Examiner*—John Sipos

*Attorney, Agent, or Firm*—Ostrolenk, Faber, Gerb & Soffen

[57] ABSTRACT

The invention relates to a machine for crimping in a controlled atmosphere constituted by a frame forming a support for a crimping head rotated about a vertical axis and for a device for supplying and evacuating the sub-assemblies to be assembled, said device and the frame cooperating to constitute an enclosure surrounding the crimping head and adapted to be connected to a source of vacuum or of neutral gas. According to the invention, the said enclosure is shaped at least for one part in an element in the frame mobile with respect to the rest of the support structure about a lateral pivot axis parallel to the axis of rotation of the crimping head forming door adapted to be closed in sealed manner on a front surface of join arranged on the said fixed structure. The head is mounted on a pivoting bracket. The invention is more particularly applicable to packing food products.

4 Claims, 6 Drawing Figures

Fig. 1
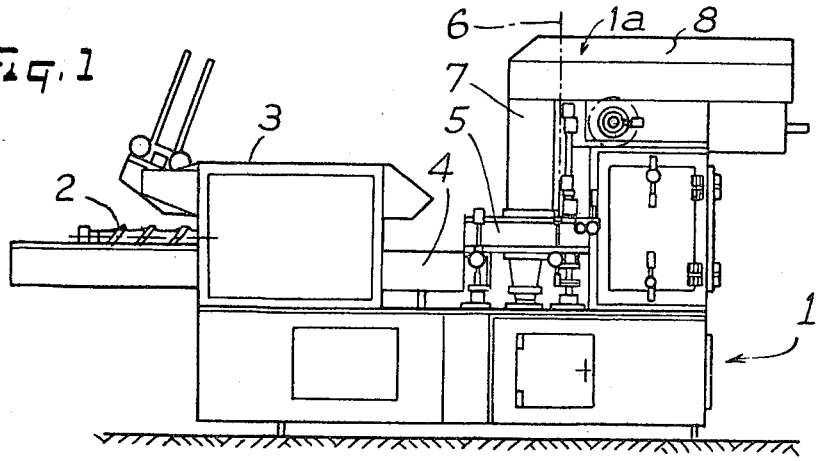
Fig. 2
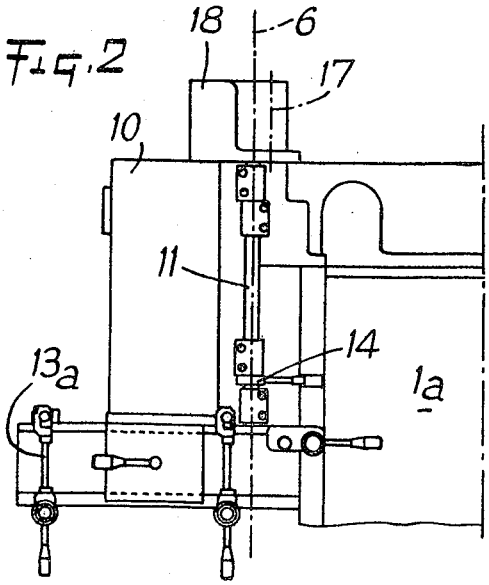
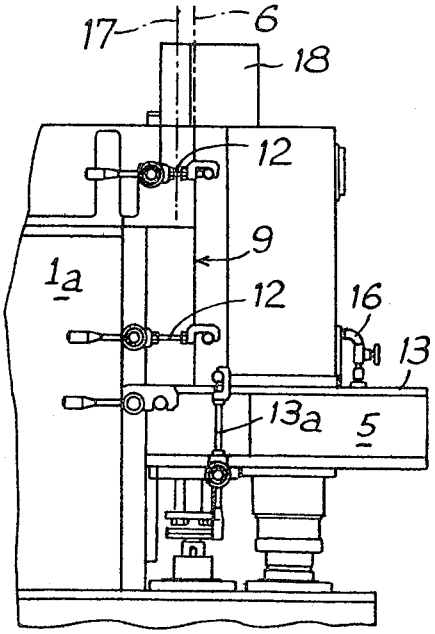
Fig. 3
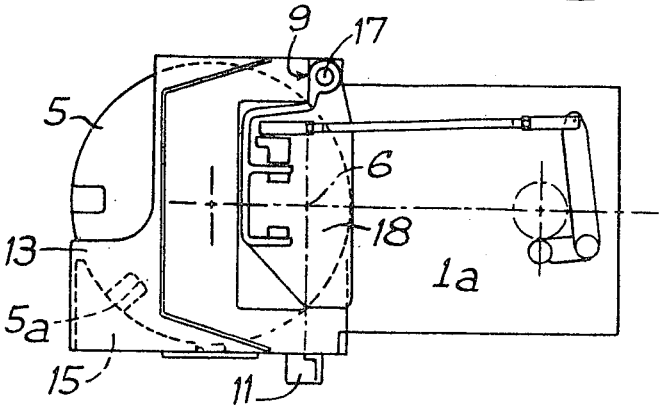
Fig. 4

MACHINE FOR CRIMPING IN A CONTROLLED ATMOSPHERE

The present invention relates to a machine for crimping under vacuum, adapted in particular to assemble a can bottom or lid with the body of said can previously filled with foodstuff or the like.

In the case of packing food products, either a crimping in vacuo or a crimping in a neutral atmosphere is carried out to ensure better preservation of the contents of the can. This process will be referred to as crimping in a controlled atmosphere. The actual crimping consists in seaming by a set of rollers brought in contact and deforming together the edges of the elements to be crimped in the course of a relative peripheral movement between the can and the rollers.

For cans of non-circular section, the can is maintained fixed during the crimping operation whilst the roller assembly carried by a crimping head rotates about the can.

Crimping in a controlled atmosphere (vacuum or neutral gas) involves the necessity of enclosing the crimping head in an enclosure in which are introduced the can elements to be crimped by means of an air-lock ensuring insulation of the enclosure with respect to the outer atmosphere.

The fact that the head is enclosed makes it difficult to have access to it. Now, it is necessary to reach this head to proceed, on the one hand, with adjustments and maintenance thereof and, on the other hand, with modifications in its adjustments for dealing with containers of different characteristics with the same head. These adjustments are often long and delicate operations even when openings have been provided in the enclosure to this end, and require numerous assemblies and dismantlings.

It is an object of the present invention to remedy these drawbacks by proposing a device for crimping shaped cans in a controlled atmosphere, said device having a crimping head which is perfectly accessible, rapidly, without complex assembly and dismantling operations.

To this end, the invention relates to a machine for crimping in a controlled atmosphere, constituted by a frame forming support for a crimping head rotated about a vertical axis and for a device for supplying and evacuating the sub-assemblies to be assembled, moving in a plane substantially perpendicular to said axis and partly beneath said head, said device and the frame cooperating to constitute an enclosure surrounding the crimping head and adapted to be connected to a source of vacuum or of neutral gas, said enclosure being shaped at least for part in an element of the frame mobile with respect to the fixed remainder of the frame.

According to one of the main features of the invention, this element is pivoted on this fixed part about a lateral axis parallel to the axis of rotation of the crimping head forming door adapted to be closed in sealed manner on a front surface of join arranged on the said fixed structure, whilst the said crimping head is mounted to rotate in a support itself pivoted on the frame about a lateral axis parallel to the pivot axis of said door and transversely opposite the axis, this support constituting a bracket for supporting the crimping head for its positioning in or extraction from the said enclosure. In a preferred embodiment, said bracket comprises a sleeve for guiding said crimping head of which the vertical axis is in working position, placed and retained substantially in the plane of the said surface of join, fastening means being provided in register between said surface and said sleeve.

In this configuration, the drive of the crimping head is ensured by means of toothed wheels coaxial to its axis, located beneath said sleeve and capable of meshing in said work position with corresponding toothed wheels provided in fixed manner in the frame in the vicinity of the enclosure, in a box with toothed wheels open towards the surface of join. Said box is provided at said opening with a closure element pivoted on the frame in the vicinity of said surface of join forming closed casing around the crimping head when coupling thereof is effected and ensuring the seal of the box with toothed wheels with respect to the enclosure.

The invention will be more readily understood on reading the following description with reference to the accompanying drawings, in which:

FIG. 1 is a schematic view in elevation of the machine according to the invention.

FIG. 2 is a partial side view of FIG. 1.

FIG. 3 is another partial side view of FIG. 1, opposite that of FIG. 2.

FIG. 4 is a plan view of the machine at crimping head level, in its position of adjustment.

Figure 5:
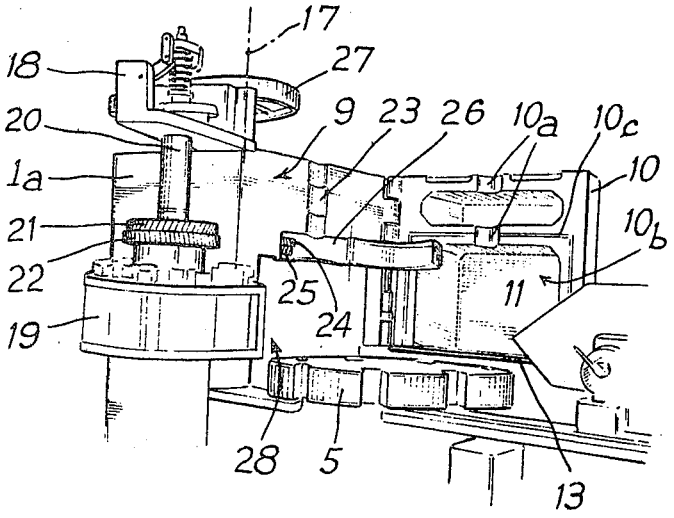
FIG. 5 is a partial view in perspective of the machine at crimping head level.

Referring now to the drawings, FIG. 1 shows that the machine according to the invention comprises a frame 1 supporting a transfer mechanism for supplying and evacuating the elements to be crimped and crimped, comprising a device 2 for guiding the can bodies, a device 3 for storing and guiding the lids or bottoms, a device 4 for transferring the can bodies equipped with their lid or bottom, not crimped, and a carousel 5 for taking these cans and placing them at the crimping station and evacuating them.

This mechanism extends in a horizontal plane so that its right hand end in the Figure is located beneath a part 1*a* of the frame provided with the crimping head. Said crimping head which is not visible in this Figure is rotated about a vertical axis 6 by part 1*a* of the frame. It is enclosed in an enclosure of which an outer wall 7 is visible.

FIGS. 2, 3 and 4 show in greater detail the said part 1*a* of the frame from which an upper casing 8 has been removed. This part of the frame has a front surface 9 (FIG. 3) covered by a pivoted element 10 forming a door. The pivot axis 11 of this door is lateral and parallel to the axis 6 of rotation of the crimping head. This door is maintained applied against the front surface 9 by means of hooks 12 located on the other side of the frame with respect to axis 11. In addition, said door is provided with a lower plate 13 which forms a seal with the upper surface of the carousel 5. The door is mounted to slide slightly on its pivot axis 11. A cam surface 14 makes it possible to lift the door with respect to frame parts 15 on which it abuts and is hooked at 13*a*, and, after unlocking of the hooks 12 and 13*a* to facilitate opening thereof.

The plate 13 further constitutes a means for obturating the recesses 5*a* of the carousel which pass thereunder cooperating with lateral walls of the parts 15, and a bottom plate of the recesses 5*a*, it closes said recesses and they are isolated from the outer atmosphere. The interior of these recesses, therefore the can they contain, is placed in an atmosphere similar to that of crimping, by means of a supply 16 of neutral gas or vacuum. In addition, these recesses form an air lock for the introduction of the cans beneath the crimping head. The door 10 is internally recessed and thus constitutes a removable wall of an enclosure with controlled atmosphere in which the crimping head which will be more clearly described with reference to FIG. 5, operates.

In its top part, the part 1*a* of the frame has, near its front face 9, a pivot axis 17 parallel to and laterally opposite the axis 11. An upper support 18 is pivoted on the frame about this axis 17. This support constitutes a bracket for supporting the crimping head making it possible to pivot its axis 6 from a position where it merges substantially with the plane of the front face 9 to another position illustrated in FIG. 5 in which the crimping head is placed in lateral overhang with respect to the carousel 5.

In this FIG. 5, which shows part 1*a* of the frame with the door 10 open, certain of the elements already described are found, with the same references. 19 denotes the crimping head of the machine. It is suspended from the bracket 18 which comprises a sleeve 20 in which is rotatably mounted the shaft of axis 6 of the head 19. Pinions 21 and 22 for driving the elements (not shown), inside the crimping head, are placed coaxially to said sleeve 20. By rotating the bracket 18 around the axis 17, the crimping head is placed in its work position above the crimping station of the carousel 5. In this position, the sleeve 20 is placed in semicylindrical housings 23 made in the front face 9 of the frame and the toothed wheels 21, 22 mesh with corresponding toothed wheels 24, 25 provided in a box 26 opening on the face 9 and driven in rotation by means of a drive device of which the drive belt 27 is visible. The frame 1*a* possesses a cavity 28 for receiving part of the crimping head 19, which is bordered by the said front face 9. The door 10 itself comprises semi-cylindrical housings 10*a* for surrounding the sleeve 20 when it is closed on the wall 9 and a cavity 10*b* corresponding to the cavity 28 of the frame to house the other part of the crimping head. Around the cavity 10*b*, a seal 10*c* provides tightness from outside the enclosure formed by the cavities 28 and 10*b* on three of their sides. Tightness at lower level is ensured, as indicated hereinabove, by means of the plate 13 fast with the door and very close to the carousel 5.

Figure 6:
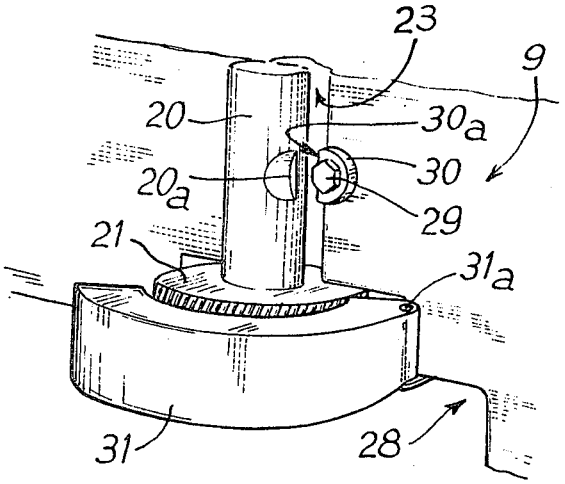
FIG. 6 is a view in perspective of a detail of FIG. 4.

Finally, it will be noted, with reference to FIG. 6, that the sleeve 20 is immobilised in its housing 23 by means of a clamping member comprising a screw 29 screwed in the frame 1*a* and a washer 30 having a cant 30*a*. A countersunk hole 20*a* in the sleeve is disposed so as to constitute a support face for the cylindrical part of the washer 30 when the screw 29 is screwed, dismantling being effected by disengaging the said cylindrical part from this hole 20*a* and placing the cant opposite the hole as shown in FIG. 6. Furthermore, a casing 31 is pivoted at 31*a* on the frame near the front face 9 and may close the box 26 with gears in substantially tight manner with respect to the enclosure 28,10*b*. The means for clamping this casing 31, which are known per se, have not been shown in this Figure.

The above description shows the features of the invention by means of which it is an easy matter to close the enclosure under controlled atmosphere, or to open it and remove or replace, easily and rapidly, the crimping head which was adjusted or modified whilst it was placed, by the bracket 18, in overhang on the side of the frame and very easily accessible, as ilustrated in FIG. 5.

The invention renders a crimping machine equipped with the above characteristic means very versatile in use and adjustment, due to which the immobilisation time is considerably reduced. Profitability of the machine increases accordingly.

The invention is particularly applicable in the domain of packing machines.

It is not limited to the description which has just been given but covers, on the contrary, all the variants which may be made thereto without departing from the scope thereof.

What is claimed is:

1. In a machine for crimping sub-assemblies in a controlled atmosphere, comprised of a frame forming support for a crimping head rotated about a vertical axis and for a device for supplying and evacuating the sub-assemblies to be assembled, moving in a plane substantially perpendicular to the said axis and partly beneath said head, said device and the frame cooperating to form an enclosure surrounding the crimping head and a source of vacuum or of neutral gas connected to said enclosure, the said enclosure being shaped at least for part in an element of the frame mobile with respect to the fixed remainder of the frame, means for pivotally mounting said element on said frame about a lateral axis parallel to the axis of rotation of the crimping head forming a door to be closed in tight manner on a front surface of join arranged on said fixed frame, and the said crimping head is mounted to rotate in a support, means for pivotally mounting said support to the frame to pivot out of the enclosure about a lateral axis parallel to and transversely opposite the pivot axis of said door and on opposite side of said crimping head axis, said support comprising a bracket for supporting the crimping head for its positioning in or pivoting out of said enclosure.

2. The machine of claim 1, wherein said bracket comprises a sleeve for guiding said crimping head of which the vertical axis is in work position when placed and retained substantially in the plane of the said surface of join, clamping means being provided in register between said surface and said sleeve.

3. The machine of claim 2, wherein the drive of the crimping head is ensured by means of toothed wheels coaxial to its axis located beneath said sleeve and adapted to mesh in said work position with corresponding toothed wheels provided in fixed manner in the frame near the enclosure, in a box with toothed wheels open towards the surface of join.

4. The machine of claim 3, wherein said box is provided at its opening with a closure element pivoted on the frame near said surface of join forming closed casing around the wheels when they are coupled and ensuring seal of the box with toothed wheels with respect to the enclosure.

* * * * *